US005384941A

United States Patent [19]

Welser

[11] Patent Number: 5,384,941

[45] Date of Patent: Jan. 31, 1995

[54] CANVAS-BLIND TUBE

[75] Inventor: Wolfgang Welser, Ybbsitz, Austria

[73] Assignee: Josef Welser oHG et al., Ybbitz, Austria

[21] Appl. No.: 962,431

[22] PCT Filed: Jun. 28, 1991

[86] PCT No.: PCT/EP91/01220

§ 371 Date: Oct. 16, 1992

§ 102(e) Date: Oct. 16, 1992

[87] PCT Pub. No.: WO92/00436

PCT Pub. Date: Jan. 9, 1992

[30] Foreign Application Priority Data

Jun. 28, 1990 [DE] Germany ..... 9007180[U]

[51] Int. Cl.[6] ..... E06B 9/171

[52] U.S. Cl. ..... 24/462; 160/395

[58] Field of Search ..... 24/460, 462; 160/383, 160/391, 395, 23.1, 67

[56] References Cited

U.S. PATENT DOCUMENTS 4,467,504 8/1984 Quist ..... 24/462

FOREIGN PATENT DOCUMENTS 1482223 5/1967 France .
2365013 4/1978 France .
2491121 4/1982 France .
302101 2/1917 Germany .
7507473 6/1975 Netherlands ..... 160/395

*Primary Examiner*—James R. Brittain
*Attorney, Agent, or Firm*—Skjerven, Morrill, MacPherson, Franklin & Friel

[57] ABSTRACT

In order to facilitate the fastening of a length of material to the cold-rolled profile tube (1) of a canvas-blind tube, the wall of said profile tube has formed therein an essentially tangentially extending first recess by folding the wall of said profile tube first inwards onto itself and by bending it then back into an L-shape, the long leg portion (9) extending in parallel spaced relationship with said double-folded wall and the shorter L-leg portion (10) extending towards the outer surface of said profile tube (1) and delimiting the opening of said first recess. Furthermore, a second, radially extending recess is provided subsequent to said shorter L-leg portion (10) by bending the wall inwards in a U-shape. These recesses have inserted therein a strip of plastic material comprising a tongue, which extends into the first recess, and a foot portion, which follows said tongue and which extends into the second recess (11), the length of canvas-blind material being placed round said tongue. The length of canvas-blind material can thus be held by radially inserting the strip of plastic material into the canvas-blind tube, without there being any necessity of providing additional fastening means.

9 Claims, 2 Drawing Sheets

CANVAS-BLIND TUBE

DESCRIPTION

Figure 1:
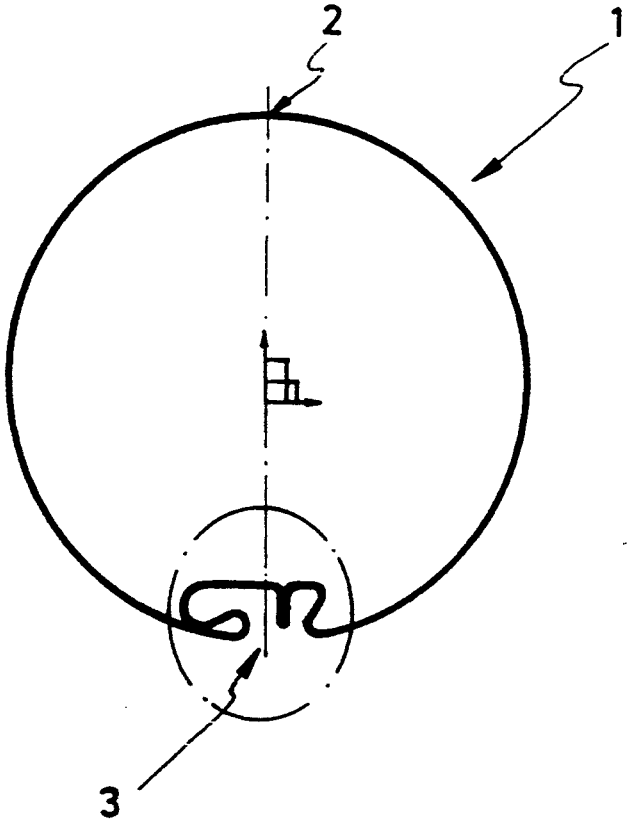

The present invention refers to a canvas-blind tube comprising a cold-rolled profile tube whose outer surface has formed therein at least one recess, which extends in the longitudinal direction of the profile tube and which is defined by the wall of said profile tube, the end of a length of canvas-blind material and at least one rod for fastening said length of canvas-blind material being adapted to be inserted into said recess.

Such a canvas-blind tube is known e.g. from FR-A-23 65 013. The cold-rolled profile tube is provided with a dovetailed groove, which is formed in said profile tube and which has inserted therein a trapezoidal holding rod. It is no longer necessary to sew up the rod in the canvas-blind material because said material can be clamped in position between the holding rod and the groove. It is, however, necessary that the rod is inserted in the axial direction of the profile tube, and this will normally require a complete removal of the canvas-blind tube, when a worn length of canvas-blind material has to be exchanged, since the lateral space available for inserting the rod will not suffice in most cases.

German-pat. 302 101 shows a curtain rod with triangularly arranged grooves in which the curtain material can be clamped in position by means of strips. In order to prevent these strips from falling out, triangular end pieces are inserted into the ends. It is thus, in principle, possible that the strips together with the curtain material are inserted radially into the curtain rod from outside, but, subsequently, separate parts; viz. said end pieces, have to be inserted axially.

Hence, the present invention is based on the task of improving a canvas-blind tube of the type mentioned at the beginning in such a way that the length of canvas-blind material can be installed more easily.

In accordance with the present invention, this task is solved by the features that, for forming an essentially tangentially extending first recess, the wall of the profile tube is first folded inwards onto itself and is then bent back in an L-shape, the long L-leg portion extending in parallel spaced relationship with the double-folded wall and the shorter L-leg portion extending towards the outer surface of the profile tube and delimiting the opening of said first recess, and that, for forming an essentially radially extending second recess, the wall following said shorter L-leg portion is bent inwards in a U-shape, one of the two legs of said U-shape extending parallel to the shorter L-leg portion, whereas the other leg extends in spaced relationship therewith and merges at its free end with the cylindrical portion of the tube wall, said rod being constructed as a strip of plastic material comprising a tongue extending into said first recess and a foot section following said tongue and extending into the second recess.

This solution permits the rod to be inserted first tangentially and then radially into the recess of the profile tube after having put the length of canvas-blind material round the tongue extending into the first recess. Sewing up of the strip of plastic material in the end of the length of canvas-blind material is not necessary, and also an axial insertion of the strip is superfluous. Nor is it necessary to use any additional holding means for the strip. This canvas-blind tube is advantageous not only insofar as the length of canvas-blind material can be attached to the profile tube more easily but also insofar as it is much less difficult to provide the length of canvas-blind material in an aligned position, since the insertion of the strip of plastic material will no longer cause any displacements of the length of canvas-blind material. An additional advantage of this structural design is to be seen in the fact that it will suffice when the two recesses extend radially into the interior of the tube much less far than in the case of the structural designs according to the prior art. Hence, more space for the drive motor will be available in the interior of the profile tube. The tongue of the strip of plastic material around which the length of canvas-blind material has been placed is prevented from radially yielding by the tangentially extending recess, whereas the foot section, which engages the radial recess, prevents the strip of plastic material from moving tangentially.

When the legs of the U-shape of the wall of the second recess converge towards their free ends defining the opening of said second recess, also said second recess will be able to counteract a radial movement of the strip of plastic material.

It will be expedient, when the double-folded part of the wall of the profile tube in the area between the opening of the first recess and the free end of the long L-leg portion has the shape of a horizontal S. The end of the length of canvas-blind material clamped in position in said first recess can thus be drawn out of the first recess in several windings, whereby a good frictional engagement will be achieved on the one hand and creases in the length of canvas-blind material will be avoided on the other.

Insertion of the strip of plastic material can be facilitated, when the tongue extends essentially parallel to the long L-leg portion of the L-shaped wall section of the first recess.

In order to bring the strip, which is used for fastening the end of the length of canvas-blind material, to a defined position, it proved to be advantageous when said strip includes a U-shaped connecting portion, which interconnects the tongue and the foot section and the legs of which extend essentially down to the bottoms of the first and second recesses. It follows that, by means of this U-shaped connecting portion, the strip is attached to and fixed on the web separating the two recesses from each other.

For holding the end of the length of canvas-blind material, which is retained in the recess of the profile tube, even more reliably, it will be advantageous if the free end of the tongue of the strip of plastic material is angled. When the strip of plastic material has been installed, this angled end extends up to a wall section located opposite the long L-leg portion of the wall. This has the advantage that, when a pulling force is applied to the length of canvas-blind material, the tongue will yield resiliently and its angled end will clamp said length of material in position at the opposite wall. It follows that the length of canvas-blind material can only be removed if the strip has been released previously.

In accordance with a further development of the present invention, the foot section can comprise a clamping web, which is resiliently mounted on the connecting portion in the area of the leg extending into the second recess and which rests against the opposite wall of the second recess. Such a clamping web, which has to be pressed onto the neighboring leg of the connecting portion upon insertion of the strip of plastic material, guarantees that the strip of plastic material will be held firmly when it has been installed.

This holding effect can be increased still further due to the fact that the clamping web and the leg of the connecting portion define together a V-shape which opens into the second recess. In combination with the converging wall sections of the second recess, it will thus also be achieved that the strip of plastic material will be fixed in the radial direction relative to the axis of the profile tube.

When the connecting portion is equipped with ribs provided on one of the sides of the legs which face one another, the opening of the connecting portion can be enlarged on the one hand without impairing the desired clamping effect on the other.

Figure 2:
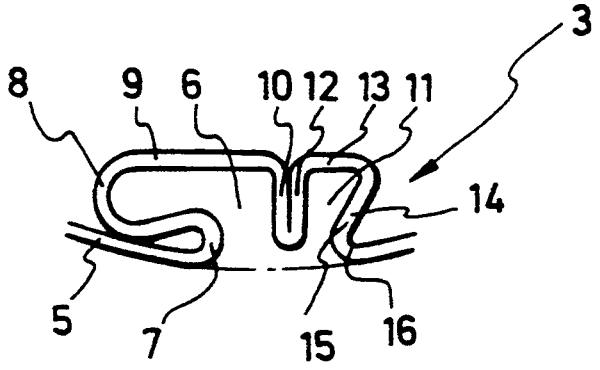
Figure 5:
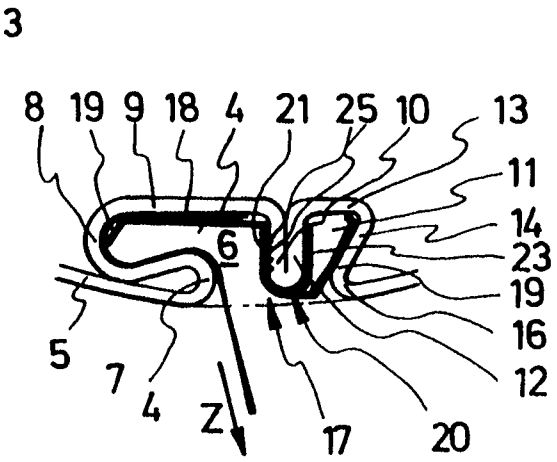
Figure 4:
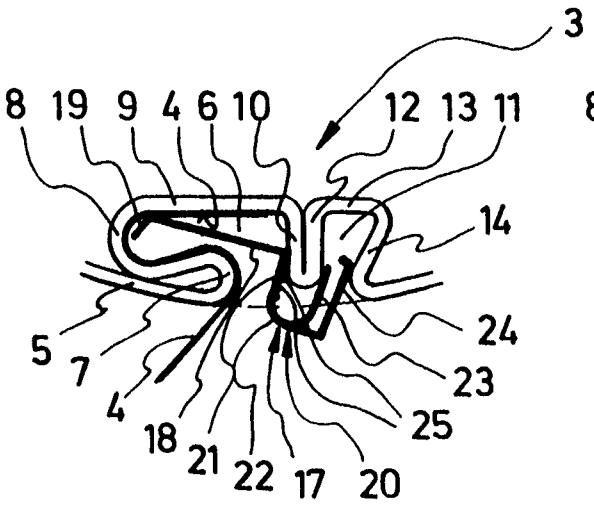
Figure 3:
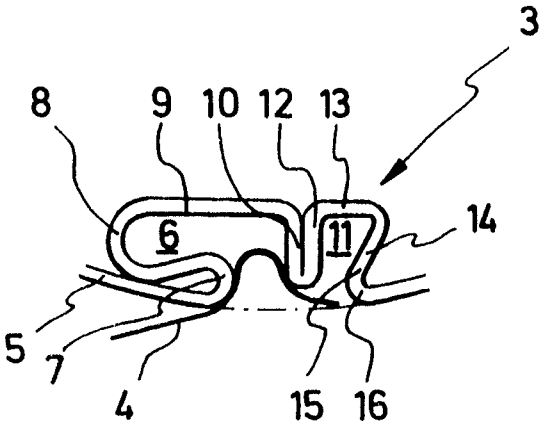

In the following, one embodiment of the present invention will be explained in detail on the basis of a drawing, in which:

FIG. 1 shows a cross-section through a profile tube according to the present invention, FIG. 2 shows detail reception portion 3 of FIG. 1, FIG. 3 shows the detail of FIG. 2 upon insertion of the end of the length of canvas-blind material to be fastened, FIG. 4 shows said detail upon insertion of the strip of plastic material, and FIG. 5 shows said detail when the end of the length of canvas-blind material has been fastened and when the strip of plastic material has been inserted.

FIG. 1 shows a cross-sectional view of a profile tube 1 for a canvas-blind drive means. The profile tube is essentially cylindrical and consists of a cold-rolled sheet metal part, which is welded together at point 2 so as to form a closed tube. At the side located opposite the welding seam 2, the profile tube 1 has a reception portion 3 for the length of canvas-blind material 4 to be secured to the profile tube 1 (cf. FIG. 3 to 5). In the interior of the profile tube 1, the motor for driving the profile tube is provided, said motor being, however, not shown for the sake of clarity.

FIG. 2 to 5 show the reception portion 3 of said profile tube 1 in detail.

As can be seen on the basis of FIG. 2, the wall 5, which comes from the left, first extends in the cylindrical subsection. For defining a first recess 6, the wall 5 is folded back in the form of a horizontal S. A first bend 7 and a second bend 8 of slightly larger diameter are thus formed, said second bend 8 being located opposite said first bend 7 and being in contact with the inner side of the tube wall.

The end of the second bend 8 is followed by an L-shaped wall section including the longer L-leg portion 9. The longer L-leg portion 9 extends parallel to an imaginary tangent applied to the periphery of the profile tube. The long L-leg portion 9 is followed by a shorter L-leg portion 10 extending radially towards the outer periphery of the profile tube and ending at a short distance therefrom. For forming a second recess 11, the wall 5 is bent in a U-shape after the shorter L-leg portion, a first leg 12 of said U-shape extending parallel to the shorter L-leg portion 10 and in contact therewith. The first leg 12 of the U-shape is followed by the crossweb 13, which extends such that it defines an extension of the long L-leg portion 9. Said crossweb 13, in turn, is followed by the second leg 14 of the U-shape, said second leg 14 converging towards said first leg 12 in the direction of its free end 15. From the free end 15 of the second leg 14 onwards, the wall 5 merges again with the cylindrical wall portion via a bend 16.

As can be seen from FIG. 2, the first recess 6 extends essentially in the tangential direction, whereas the second recess 11 extends essentially in the radial direction.

In FIG. 5, a strip of plastic material 17, which will be described hereinbelow, is inserted into the two recesses 6 and 11. Said strip of plastic material 17 comprises a tongue 18, which extends essentially parallel to and directly adjacent to the longer L-leg portion 9 and the free end 19 of which is angled towards the second bend 8 of the wall.

The other end of the tongue 18 is followed by the free end of a first leg 21 of a U-shaped connecting portion 20. Said first leg 21 extends parallel to the shorter L-leg portion 10 of the wall and merges with a crossweb 22, which, in turn, is followed by a second leg 23 extending parallel to the first leg 12 of the wall of the second recess 11 and approximately down to the bottom of said recess.

In addition, a clamping web 24 is resiliently mounted at the location at which the crossweb 22 merges with the leg 23. Said clamping web 24 extends parallel to the second leg 14 of the wall defining the second recess 11 and, when the strip of plastic material 17 has been inserted, it abuts on said wall.

The side of the first leg 21 of the connecting portion 20 facing said second leg 23 has formed thereon ribs 25 holding said first leg 21 in spaced relationship with the shorter L-leg portion 10 of the wall of said first recess 6. The clamping web 24 defines together with said second leg 23 a foot section, which extends into the second recess 11 and which serves to lock the strip of plastic material 17 on the profile tube 1.

In the following, the mode of operation and the function of the embodiment shown in the drawing will be explained in detail.

FIG. 3 shows how the end of a length of canvas-blind material 4 is placed on top of the opening of the first recess 6. Depending on the thickness of the canvas-blind material, it may be attempted to push—in the manner shown in FIG. 3—the material into said first recess 6 as far as possible. This is, however, not absolutely necessary, since the canvas-blind material can also be pressed into said first recess 6 by the tongue 18 of the strip of plastic material 17, as can be seen from FIG. 4. Said FIG. 4 also shows that, for inserting the strip of plastic material, the free end 19 of the tongue 18 of said strip is first introduced into said first recess 6. The strip of plastic material is inserted to such an extent that the connecting portion 20 is positioned above the shorter L-leg portion 10 and the first leg 12 of said second recess 11. The clamping web 24 is then pressed onto the leg 23 so that said clamping web 24 and said leg 23 can be forced into the second recess 11. In view of the fact that the strip of plastic material is not completely rigid, the clamping web need not be pressed together throughout the whole length of the strip of plastic material for the purpose of inserting said strip; on the contrary, it is possible to start at one end of the strip of plastic material and to press said clamping web 24 onto said leg 23 at the respective leading section as well as to force the strip of plastic material 17, simultaneously, into the second recess 11 at the respective trailing section.

A soon as the strip of plastic material has been inserted, the resilient clamping web 24 will rest against the wall of said second recess 11, and unintentional removal of the strip of plastic material 17 will thus be impossible.

Starting at the long L-leg portion 9, the canvas-blind material 4 is now in contact with the wall of the first recess 6. In this condition, the canvas-blind material is pressed against the wall (second bend 8) by the tongue 18 and especially by the angled free end 19 of said tongue. This clamping force will even increase, if a pulling force is applied to the length of canvas-blind material 4 in the direction of arrow Z.

The present description shows clearly that, for holding the length of canvas-blind material in position, it is no longer necessary to sew up a strip at the end of the length of material. Furthermore, the canvas-blind tube according to the present invention permits the strip to be inserted from the circumferential side of the tube. The canvas-blind material can thus also be exchanged in cases in which the canvas-blind tube is installed under narrow space conditions, without there being any necessity of removing the whole tube.

I claim:

1. A canvas-blind tube comprising a cold-rolled profile tube whose outer surface has formed therein at least one recess (6), which extends in the longitudinal direction of the profile tube (1) and which is defined by a wall (5) of said profile tube, an end of a length of canvas-blind material (4) and at least one rod (17) for fastening said length of canvas-blind material being adapted to be inserted into said recess (6), characterized in that, for forming an essentially tangentially extending first recess (6), the wall (5) of the profile tube is first folded inwards onto itself to form a double folded wall and is then bent back in an L-shape, a long L-leg portion (9) extending in parallel spaced relationship with the double folded wall and a shorter L-leg portion (10) extending towards an outer surface of the profile tube (1) and delimiting an opening of said first recess (6), and that, for forming an essentially radially extending second recess (11), the wall following said shorter L-leg portion (10) is bent inwards in a U-shape having two legs (12,14), one of the two legs (12) of said U-shape extending parallel to the shorter L-leg portion (10), whereas the other leg (14) extends in spaced relationship therewith and merges at an end (15) thereof with a cylindrical portion of the tube wall (5), said rod being constructed as a strip of plastic material (17) comprising a tongue extending into said first recess (6) and a foot section (23,24) following said tongue and extending into said second recess (11).

2. A canvas-blind tube according to claim 1, characterized in that respective ends of the legs (12,14) of the U-shape converge, thereby defining an opening of the second recess (11).

3. A canvas-blind tube according to claim 1, characterized in that a section (7,8) of the wall (5) between the opening of the first recess (6) and an end of the long L-leg portion (9) has the shape of a horizontal S.

4. A canvas-blind tube according to claim 1, characterized in that the tongue (18) extends essentially parallel to the long L-leg portion (9) of the wall.

5. A canvas-blind tube according to claim 1, characterized in that the strip of plastic material (17) includes a U-shaped connecting portion (20), which interconnects said tongue (18) and said foot section (23,24), and said foot section and said tongue extend essentially down to bottoms of the first and second recesses (6,11), respectively.

6. A canvas-blind tube according to claim 1, characterized in that a free end (19) of the tongue (18) is angled.

7. A canvas-blind tube according to claim 1, characterized in that the foot section (23,24) comprises a clamping web (24), which is resiliently mounted on said connecting portion (20) and which rests against an opposite wall (14) of the second recess (11).

8. A canvas-blind tube according to claim 1, characterized in that the clamping web (24) and a leg (23) of the foot section define together a V-shape which opens into said second recess (11).

9. A canvas-blind tube according to claim 1, characterized in that ribs (25) are provided on a side of the connecting portion which faces said shorter L-leg portion.

* * * * *